US008651306B2

(12) United States Patent
Pai

(10) Patent No.: US 8,651,306 B2
(45) Date of Patent: Feb. 18, 2014

(54) FLIP GUIDE PLUG STRUCTURE FOR BOTTLE

(71) Applicant: G. Esmond International Co., Ltd., Taoyuan (TW)

(72) Inventor: Kuan-Mu Pai, Taoyuan (TW)

(73) Assignee: G. Esmond International Co., Ltd., Taoyuan (TW)

( * ) Notice: Subject to any disclaimer, the term of this patent is extended or adjusted under 35 U.S.C. 154(b) by 0 days.

(21) Appl. No.: 13/745,376

(22) Filed: Jan. 18, 2013

(65) Prior Publication Data

US 2014/0014614 A1 Jan. 16, 2014

(30) Foreign Application Priority Data

Jul. 10, 2012 (TW) ..... 101213257 A

(51) Int. Cl.
*B65D 39/00* (2006.01)

(52) U.S. Cl.
USPC ..... 215/355; 215/306; 215/309; 222/189.09; 222/471; 222/543; 222/565; 220/230; 220/796; 220/810

(58) Field of Classification Search
USPC ..... 215/306, 309, 355; 222/189.09, 471, 222/484, 543, 565; 220/230, 796, 810, 220/DIG. 19
See application file for complete search history.

(56) References Cited

U.S. PATENT DOCUMENTS

2005/0184026 A1* 8/2005 Haley ..... 215/306

* cited by examiner

*Primary Examiner* — Anthony Stashick
*Assistant Examiner* — Elizabeth Volz
(74) *Attorney, Agent, or Firm* — Chun-Ming Shih

(57) ABSTRACT

A flip guide plug structure for a bottle includes a lower main body, an upper main body, a lower plug, a guide pipe, an upper plug, a connection unit and two magnetic members. The upper main body can be opened relative to the lower main body through the connection unit, and then positioned by the attraction of the two magnetic members to prevent an unexpected closing. The flip guide plug structure of the present invention is very convenient for use.

7 Claims, 6 Drawing Sheets

FLIP GUIDE PLUG STRUCTURE FOR BOTTLE

BACKGROUND OF THE INVENTION

1. Field of the Invention

The present invention relates to a flip guide plug structure for a bottle, and more particularly, to a flip guide plug structure having an upper main body which can be opened and positioned temporarily.

2. Description of the Prior Art

A bottle is used to store liquid, such as wine, soy-bean sauce or the like, for convenient transportation. For red wine, a cork is used to cover the bottle. For beer, a metallic bottle cap is used to cover the bottle. When the bottle cap is opened, it is unable to reuse. Thus, the opening of the bottle cannot be covered. Dust or bugs may enter the bottle to pollute the liquid in the bottle. The applicant has many patents for wine plugs or guide plugs. The plug is used to cover a bottle after the bottle cap is opened. The guide plug facilitates the liquid to flow out. However, the aforesaid plugs are separate members. When in use, the plug is placed nearby and may be lost by accident, so it is somewhat inconvenient for use. Besides, the user has to take the bottle with one hand and to take the plug with another hand to open or close the plug. It is not convenient to use the guide plug. Accordingly, the inventor of the present invention has devoted himself based on his many years of practical experiences to solve these problems.

SUMMARY OF THE INVENTION

The primary object of the present invention is to provide a flip guide plug structure for a bottle which comprises an upper main body. The user can pour out the liquid of a bottle with a single hand to open the upper main body, so that a guide pipe is in an open state for the liquid of the bottle to flow out.

Another object of the present invention is to provide a flip guide plug structure for a bottle which can prevent dust from entering the bottle when the upper main body is closed to seal the guide pipe.

A further object of the present invention is to provide a flip guide plug structure for a bottle which comprises magnetic members to position the upper main body when the upper main body is opened. It is convenient for user to open the upper main body intermittently, without opening the upper main body again repeatedly.

A further object of the present invention is to provide a flip guide plug structure for a bottle which can be closed easily by pressing the upper main body downward with a single hand to release the attraction of the magnetic members.

In order to achieve the aforesaid objects, the flip guide plug structure for a bottle of the present invention comprises a lower main body, an upper main body, a lower plug, a guide pipe, an upper plug, a connection unit and two magnetic members.

The lower main body has a lower opening and a chamber therein.

The upper main body has an upper opening and a top lid on top of the upper opening.

The lower plug is preferably made of a soft material. The lower plug has a central through hole and a lower connecting member on top of the lower plug. The lower connecting member is inserted in the lower opening of the lower main body and then positioned thereat. The lower plug further comprises at least one lower annular plate at a lower end thereof.

The guide pipe comprises a ring, an outer pipe inserting through the ring and an inner pipe in the outer pipe. The lower end of the guide pipe is inserted through the lower opening of the lower main body and the through hole of the lower plug, and the ring is positioned in the chamber of the lower main body.

The upper plug is preferably made of a soft material. The upper plug comprises an upper connecting member on top of the upper plug. The upper connecting member is inserted in the upper opening of the upper main body and then positioned thereat. The upper plug further comprises at least one upper annular plate at a lower end thereof.

The connection unit is disposed on the edges of the lower main body and the upper main body. The connection unit comprises a lower connecting board on the edge of the lower main body and an upper connecting board on the edge of the upper main body. The lower connecting board has two pivot plates thereon. Each pivot plate has a lower through hole. The upper connecting board has an upper through hole. The upper connecting board has a press portion. The connection unit further comprises a pivot inserting in the two lower through holes and the upper through hole, so that the lower connecting board and the upper connecting board are connected.

The two magnetic members are located in the connection unit. The magnetic member is located beside the lower connecting board, and the other magnetic member is located under the press portion.

The guide pipe further comprises an annular member on the ring. The annular member is preferably made of a soft material.

DETAILED DESCRIPTION OF THE PREFERRED EMBODIMENTS

Embodiments of the present invention will now be described, by way of example only, with reference to the accompanying drawings.

Figure 1:
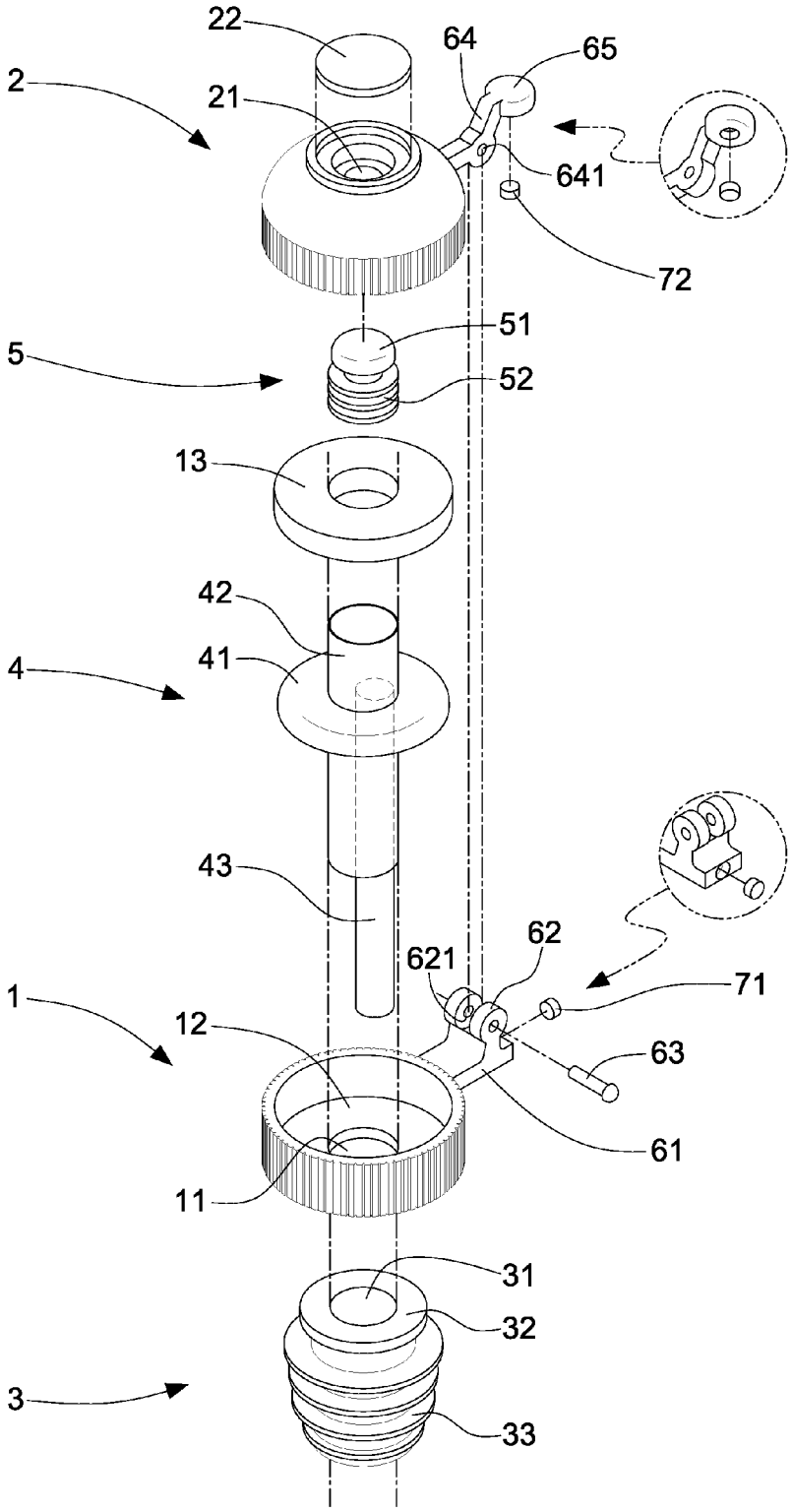
FIG. 1 is an exploded view according to a preferred embodiment of the present invention.
Figure 2:
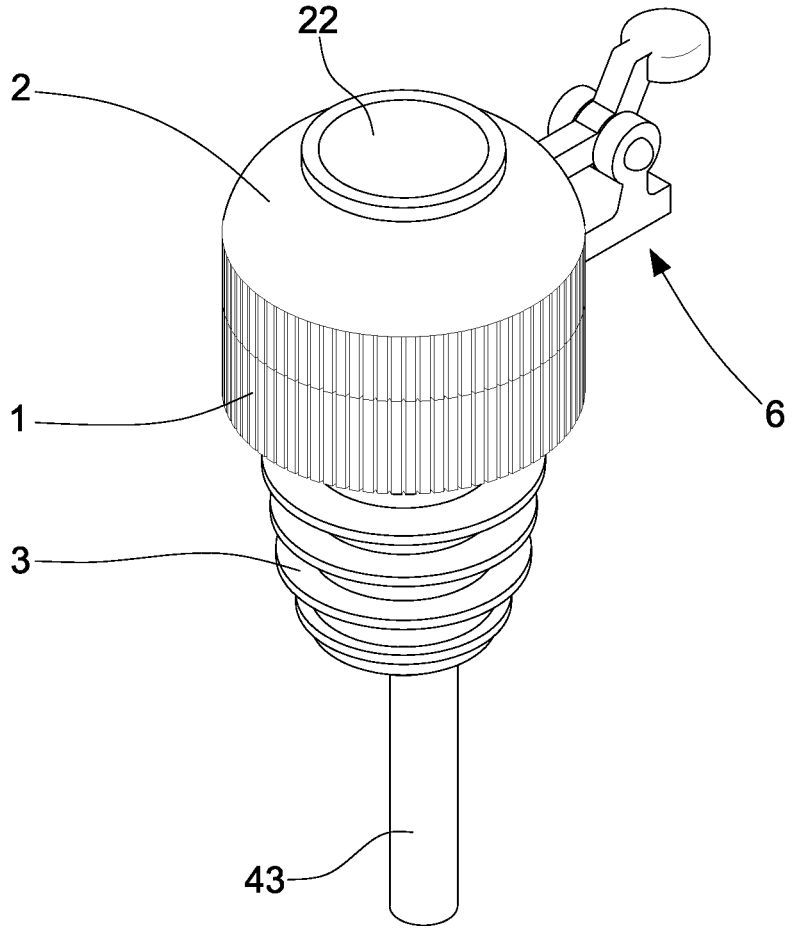
FIG. 2 is a perspective view according to the preferred embodiment of the present invention.
Figure 3:
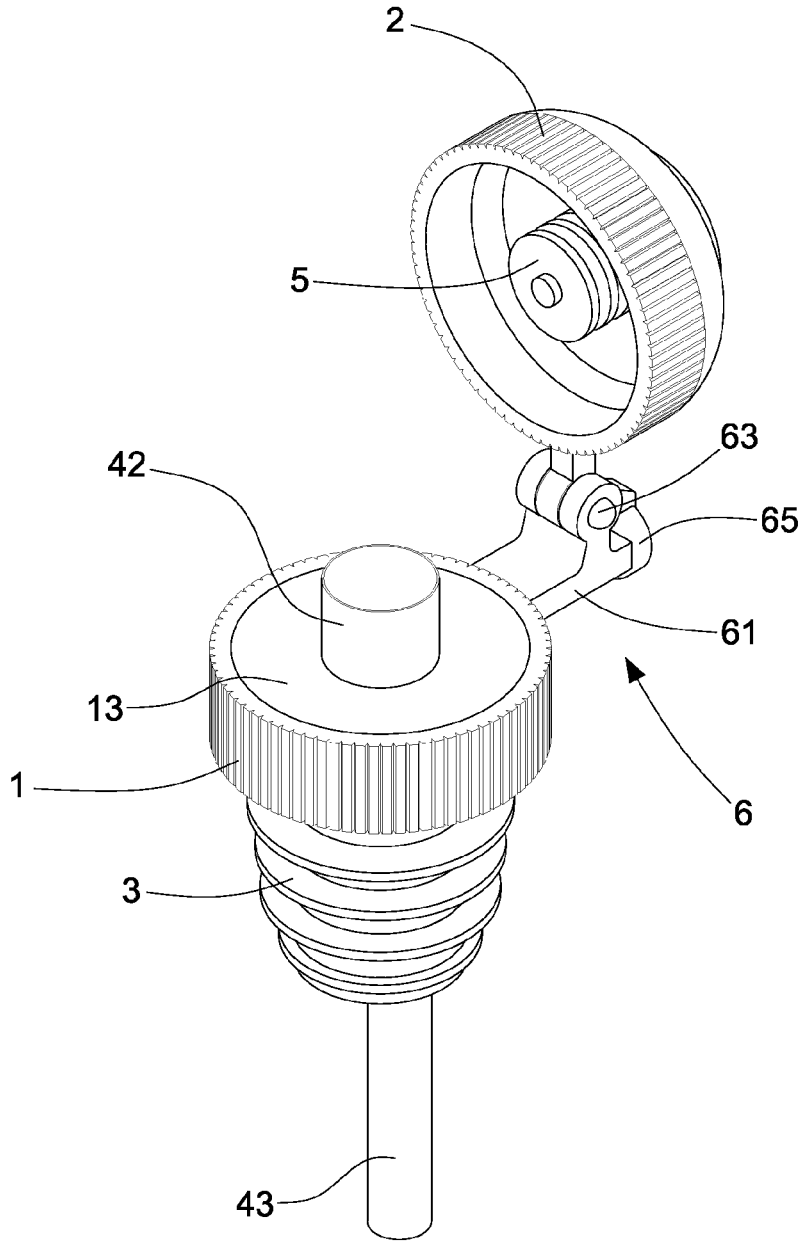
FIG. 3 is a perspective view according to the preferred embodiment of the present invention in an open state.

As shown in FIG. 1, FIG. 2 and FIG. 3, the flip guide plug structure for a bottle according to a preferred embodiment of the present invention comprises a lower main body 1, an upper main body 2, a lower plug 3, a guide pipe 4, an upper plug 5, a connection unit 6 and two magnetic members 71, 72.

The lower main body 1 has a lower opening 11 and a chamber 12 therein.

The upper main body 2 has an upper opening 21 and a top lid 22 on top of the upper opening 21.

The lower plug 3 is preferably made of a soft material. The lower plug 3 has a central through hole 31 and a lower connecting member 32 on top of the lower plug 3. The lower connecting member 32 is inserted in the lower opening 11 of the lower main body 1 and then positioned thereat. The lower plug 3 further comprises at least one lower annular plate 33 at a lower end thereof.

The guide pipe 4 comprises a ring 41, an outer pipe 42 inserting through the ring 41 and an inner pipe 43 in the outer pipe 42. The lower end of the guide pipe 4 is inserted through the lower opening 11 of the lower main body 1 and the through hole 31 of the lower plug 3, and the ring 41 is positioned in the chamber 12 of the lower main body 1.

The upper plug 5 is preferably made of a soft material. The upper plug 5 comprises an upper connecting member 51 on top of the upper plug 5. The upper connecting member 51 is inserted in the upper opening 21 of the upper main body 2 and then positioned thereat. The upper plug 5 further comprises at least one upper annular plate 52 at a lower end thereof.

The connection unit 6 is disposed on the edges of the lower main body 1 and the upper main body 2. The connection unit 6 comprises a lower connecting board 61 on the edge of the lower main body 1 and an upper connecting board 64 on the edge of the upper main body 2. The lower connecting board 61 has two pivot plates 62 thereon. Each pivot plate 62 has a lower through hole 621. The upper connecting board 64 has an upper through hole 641. The upper connecting board 64 has a press portion 65. The connection unit 6 further comprises a pivot 63 inserting in the two lower through holes 621 and the upper through hole 641, so that the lower connecting board 61 and the upper connecting board 64 are connected.

The two magnetic members 71, 72 are located in the connection unit 6. The magnetic member 71 is located beside the lower connecting board 61, and the other magnetic member 72 is located under the press portion 65.

The guide pipe 4 further comprises an annular member 13 on the ring 41. The annular member 13 is preferably made of a soft material.

Figure 4:
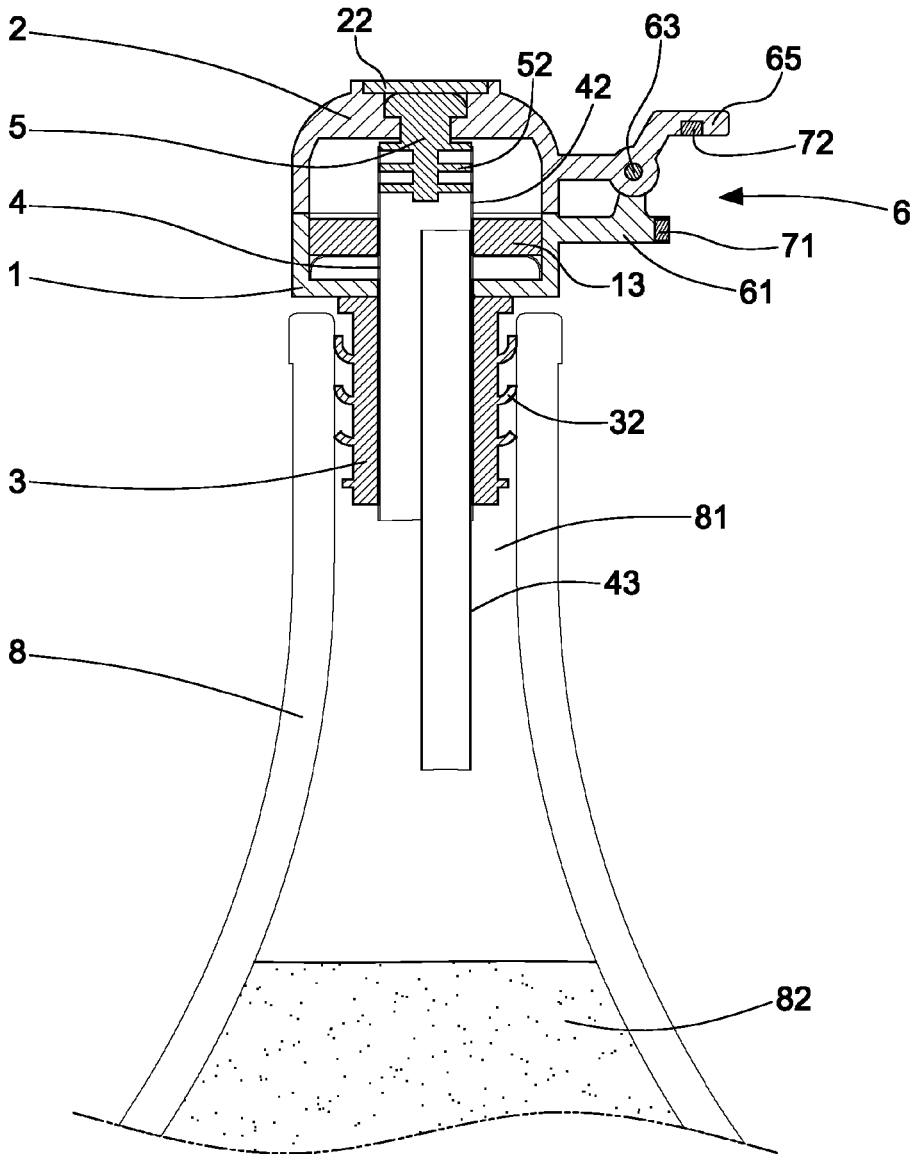
FIG. 4 is a sectional view of the preferred embodiment of the present invention in a closed state.

FIG. 4 is a sectional view of the preferred embodiment of the present invention in an open state. The flip guide plug of the present invention is inserted in the bottle opening 81 of a bottle 8. The lower annular plate 33 is located in the bottle opening 81, and the flip guide plug is attached to the bottle opening 81. Thus, the bottle opening 81 is closed to ensure the hygiene of the bottle.

Figure 5:
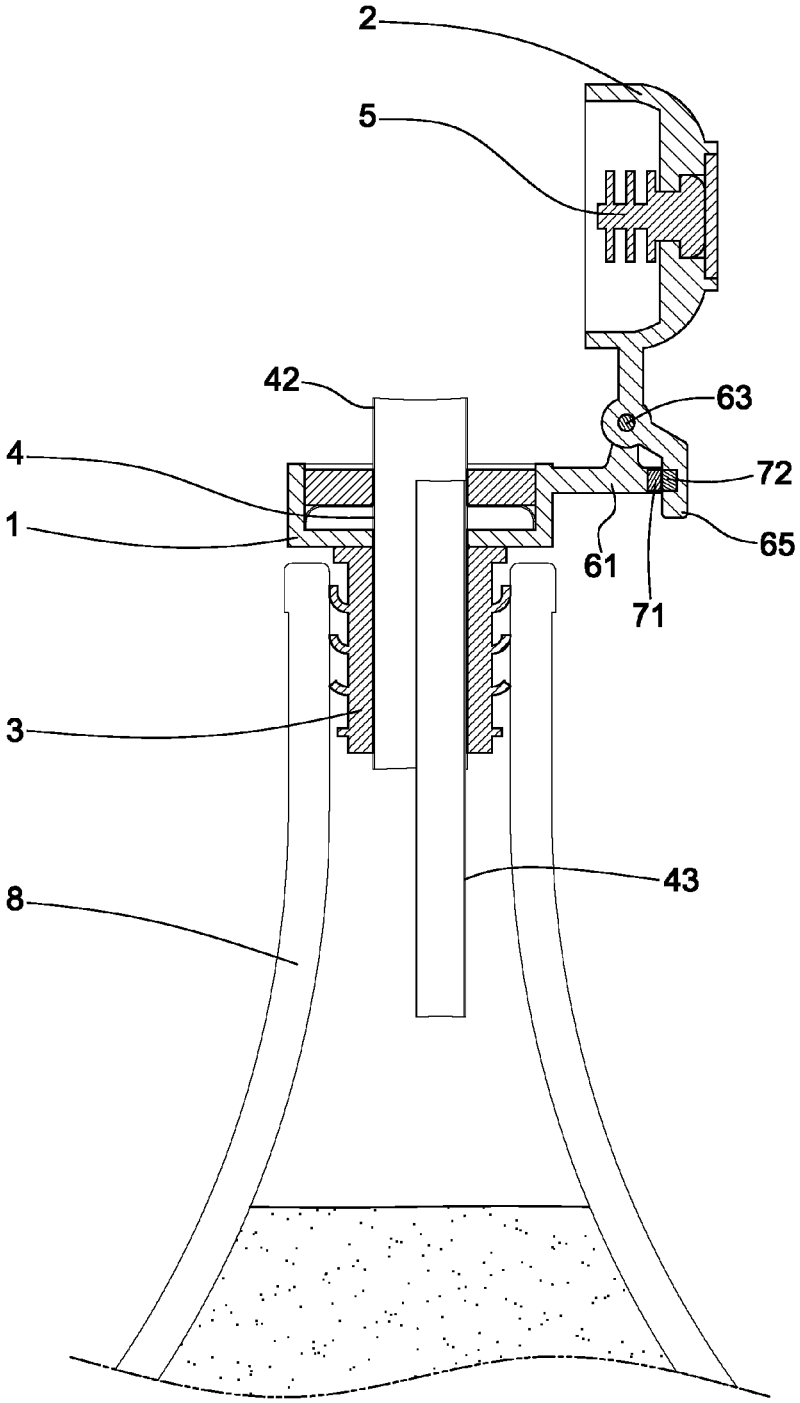
FIG. 5 is a sectional view of the preferred embodiment of the present invention in an open state.
Figure 6:
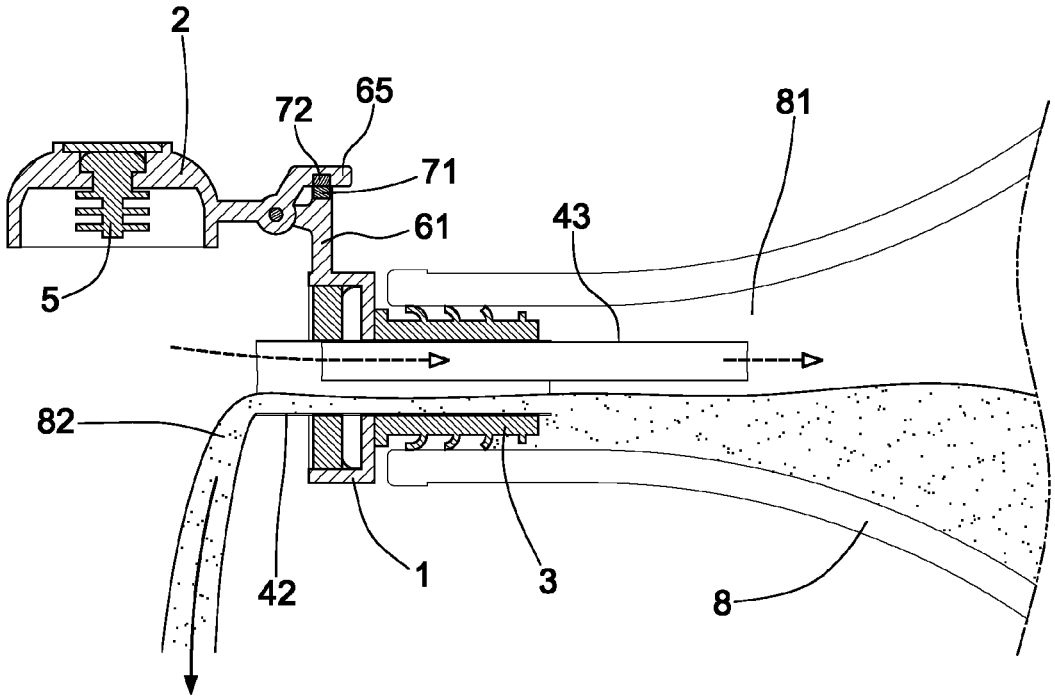
FIG. 6 is a sectional view of the preferred embodiment of the present invention when in use.

When the user wants the liquid 82 in the bottle 8 to be guided out, he/she presses the press portion 65 so that the upper main body 2 is opened relative to the lower main body 1 through the connection unit 6 according to the principle of lever. When the upper main body 2 is fully opened, the upper main body 2 is positioned by the attraction of the two magnetic members 71, 72 as shown in FIG. 5. After that, the bottle 8 is inclined for the liquid in the bottle to flow out, as shown in FIG. 6. The guide pipe 4 of the present invention comprises the inner pipe 43 therein. The inner pipe 43 is adapted for air convection. When the liquid 82 flows out through the outer pipe 42, the air flows into the bottle 8 through the inner pipe 43 so that the liquid can flow out smoothly. When the user wants to close the upper main body 2, he/she just applies a force greater than the attraction of the magnetic members 71, 72. It is easy to close the upper main body 2. When the upper main body 2 is closed, the upper plug 5 is adapted to plug the top of the guide pipe 4 to provide a seal effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A flip guide plug structure for a bottle, comprising:

a lower main body having a lower opening and a chamber therein;

an upper main body having an upper opening;

a lower plug having a central through hole and a lower connecting member on top of the lower plug, the lower connecting member being inserted in the lower opening of the lower main body and positioned thereat, the lower plug further comprising at least one lower annular plate at a lower end thereof;

a guide pipe comprising a ring and an outer pipe inserting through the ring, a lower end of the guide pipe being inserted through the lower opening of the lower main body and the through hole of the lower plug, the ring being positioned in the chamber of the lower main body;

an upper plug comprising an upper connecting member on top of the upper plug, the upper connecting member being inserted in the upper opening of the upper main body and positioned thereat, the upper plug further comprising at least one upper annular plate at a lower end thereof; and a connection unit disposed on edges of the lower main body and the upper main body to connect the lower main body and the upper main body, wherein the connection unit comprises a lower connecting board on the edge of the lower main body and an upper connecting board on the edge of the upper main body, the lower connecting board having two pivot plates thereon, each pivot plate having a lower through hole, the upper connecting board having an upper through hole, the upper connecting board having a press portion, the connection unit further comprising a pivot inserting in the two lower through holes and the upper through hole so that the lower connecting board and the upper connecting board are connected.

2. The flip guide plug structure for a bottle as claimed in claim 1, wherein the upper main body further comprises a top lid on top of the upper opening.

3. The flip guide plug structure for a bottle as claimed in claim 1, wherein the lower plug is made of a soft material.

4. The flip guide plug structure for a bottle as claimed in claim 1, wherein the guide pipe further comprises an inner pipe in the outer pipe.

5. The flip guide plug structure for a bottle as claimed in claim 1, wherein the upper plug is made of a soft material.

6. The flip guide plug structure for a bottle as claimed in claim 1, wherein a magnetic member is provided beside the lower connecting board, and another magnetic member is provided under the press portion.

7. The flip guide plug structure for a bottle as claimed in claim 1, wherein the guide pipe further comprises an annular member on the ring, and the annular member is made of a soft material.

* * * * *